United States Patent [19]

Hatagishi et al.

[11] Patent Number: 4,973,261

[45] Date of Patent: Nov. 27, 1990

[54] WIRE INSULATOR PRESSURE-CUT CONNECTOR TERMINAL

[75] Inventors: Yuji Hatagishi; Masakuni Samejima, both of Shizuoka, Japan

[73] Assignee: Yazaki Corporation, Japan

[21] Appl. No.: 509,795

[22] Filed: Apr. 17, 1990

[30] Foreign Application Priority Data

Apr. 20, 1989 [JP] Japan ..... 1-45632[U]

[51] Int. Cl.[5] ..... H01R 4/24

[52] U.S. Cl. ..... 439/397; 439/406; 29/874

[58] Field of Search ..... 439/395–407; 29/874–878

[56] References Cited

U.S. PATENT DOCUMENTS 4,324,450 4/1982 Weisenburger ..... 439/400
4,575,173 3/1986 Chapin .
4,780,092 10/1988 Fruchard et al. ..... 439/395
4,806,120 2/1989 Baker ..... 439/399

*Primary Examiner*—David L. Pirlot
*Attorney, Agent, or Firm*—Wigman & Cohen

[57] ABSTRACT

To increase the rigidity of the cutter plate portions formed with two open slots for cutting a wire insulator pressure-fitted thereinto, the wire insulator pressure-cut connector terminal comprises a base plate portion, a brimmed channel-shaped frame formed with two opposing cutter plate portions and two brim portions, and a reinforcement portion formed with two brim holder portions. Further, since the brimmed channel-shaped frame can be formed by bending a blank plate material with two mated dies having no hollow cavity between the two dies, the pressure-cut terminal can be bent into an accurate shape and in precise dimensions for providing a higher reliability of the connector terminal.

3 Claims, 4 Drawing Sheets

WIRE INSULATOR PRESSURE-CUT CONNECTOR TERMINAL

BACKGROUND OF THE INVENTION

1. Field of the Invention

The present invention relates to an insulator pressure-cut connector terminal for connecting a core conductor of a wire to a connector terminal by pressure-fitting the wire into at least one insulator cutting open slot formed in a cutter plate of the connector terminal, without stripping the insulating cover material from the wire, and in particular to an insulator pressure-cut connector terminal suitable for use in connecting a large-diameter wire thereto.

2. Description of the Prior Art

Recently, wire insulator pressure-cut connector terminals (referred to as pressure-cut terminals, hereinafter) have been widely used to improve the productivity in the assembly process of automotive vehicles, for instance, because insulator covered wires (referred to wires, hereinafter) can be connected to the pressure-cut terminal by simply pushing the wire to at least one slot for cutting the wire insulator in such a condition that the core conductor of the wire is securely brought into contact with the slot formed n a cutter plate of the pressure-cut terminal.

In the pressure-cut terminal, a flat plate is formed into a box shape; two opposing cutting open slots are formed in two opposing cutter plates of the box, respectively; and an insulated wire is pressure fitted into the open slots for connection of the wire conductor with the connector terminal.

In the conventional pressure-cut terminal, however, when a relatively large-diameter wire is pressure-fitted into the cutting open slots, there exists a problem in that the cuter plate or plates are easily deformed, and therefore the contact reliability between the wire conductor and the contact terminal is deteriorated.

To overcome the above-mentioned problem, a wire insulator pressure-cut connector terminal reinforced by two reinforcing surfaces has been proposed, as disclosed in U.S. Pat. No. 4,575,173.

FIG. 1(A) shows a perspective view of the above-mentioned prior-art pressure-cut terminal, and FIG. 1(B) is an development elevation thereof. With reference to FIGS. 1(A) and (B), the connector terminal is roughly formed with a base plate portion 1 and a box portion 2. The box portion 2 is formed with two opposing side surfaces 3*a* and 3*b* bent upright from the base plate portion 1, two cutter plate portions 4*a* and 5*a* extending from the side surface 3*a* and bent inward at right angles with respect to the side surface 3*a*, two other cutter plate portions 4*b* and 5*b* extending from the side surface 3*b* and also bent inward at right angles with respect to the side surface 3*b*, and two reinforcing surfaces 6 and 7 extending from the cutter plate portions 4*a* and 5*b* and further bent inward at right angles with respect to the cutter plate portions 4*a* and 5*b*. Further, four open wire cutting slots 8*a*, 9*a*, 8*b* and 9*b* are formed in the four cutter plate portions 4*a*, 5*a*, 4*b* and 5*b*, respectively, into each of which an insulator wire W is pressure fitted for connection of a wire conductor to the pressure-cut terminal.

In the above-mentioned prior-art pressure-cut terminal, since the two reinforcing surfaces 6 and 7 are additionally formed, although it is possible to increase the rigidity of the open slots 4*a*, 5*a*, 4*b* and 5*b*, there still exists a problem in that the cutter plate portions tend to be deformed during the bending process, as shown by solid lines in FIG. 1(C) and therefore the rigidity of the cutter plate portions are not sufficiently high, so that the cutter plate portions are easily further deformed when the wire is pressure fitted into the open slots.

The causes of the above-mentioned deformation of the cutter plate portions may be due to the following fact:

The pressure-cut terminal shown in FIG. 1(A) can be formed by bending a flat blank plate material formed into a development elevation as shown in FIG. 1(B). In FIG. 1(B), the two side surface portions 3*a* and 3*b* are formed roughly in symmetry with respect to the base plate 1; the four opposing cutter plate portions 4*a*, 5*a*, 4*b* and 5*b* extend from the side surface portions 3*a* and 3*b*, respectively; and further two reinforcing surfaces 6 and 7 extend from the cutter plate portion 3*a*, respectively.

With reference to FIGS. 2(A) to 2(E), the steps of forming each box portion 2 will be described hereinbelow. FIG. 2(A) shows a side view of a blank plate material when seen from A in FIG. 1(B). In the first step, both the reinforcing surface portions 6 and 7 are bent at a small angle by a first mated die as shown in FIG. 2(B); in the second step, the two opposing cutter plate portions 4*a* and 5*a* are bent at about 45 degrees as shown in FIGS. 2(C) by a second die; in the third step, the same two opposing cutter plate portions 4*a* and 5*a* are further bent at right angles as shown in FIG. 2(D) by a third die; and in the final step, the reinforcing surface portions 6 and 7 are bent at right angles with respect to the two opposing cutter plate portions 4*a* and 5*a* as shown in FIG. 2(E) by a fourth die.

In the above-mentioned bending process, since there inevitably exist some spaces or hollow cavities such as $C_1$, $C_2$ and $C_3$ between the second to fourth mated dies, it has been rather difficult to accurately bend the blank flat plate into a box shape as shown in FIG. 2(E), so that the corner of the cutting plate portion 4*a* or 5*a* may be deformed into an undesirable shape as shown in FIG. 1(C).

In summary, in the prior-art pressure-cut terminal, there exists a problem in that the rigidity of the open slots in the cutter plate portions is not sufficiently high and therefore the cutter plate portions are easily deformed when a relatively large-diameter insulated wire is pressure fitted into the open slot. In addition, where two reinforcing portions 6 and 7 are further formed, it has been difficult to form the pressure-cut terminal into an accurate shape and therefore to increase the rigidity of the pressure-cut terminal sufficiently high.

SUMMARY OF THE INVENTION

With these problems in mind, therefore, it is the primary object of the present invention to provide a wire insulator pressure-cut connector terminal formed with reinforcing portions, which is easy to bent into an accurate shape in precise dimensions and high in rigidity of the cutter plate portions.

To achieve the above-mentioned object, the wire insulator pressure-cut terminal, according to the present invention, comprises: (a) a base plate portion (20) formed integral with a terminal end portion (22); (b) a brimmed channel-shaped frame portion (30) formed integral with said base plate portion and having a side surface portion (31) bent at a right angle with respect to said base plate portion, two opposing cutter plate portions (32*a*, 32*b*) bent inwardly at right angles with respect to said side surface portion and formed with two open slots for cutting a wire insulator pressure-fitted thereinto respectively, and two brim portions (33*a*, 33*b*) bent outwardly at right angles with respect to said two opposing cutter plate portions respectively; and a reinforcement portion (40) formed integral with said base plate portion and bent at a right angle with respect to said base plate portion so as to be brought into contact with said two brim portions on both sides thereof (33*a*, 33*b*), and formed with at least two brim holder portions (41*a*, 41*b*) for holding said two brim portions, respectively when bent inwardly against said brim portions.

The method of forming the wire insulator pressure-cut terminal according to the present invention, comprises: (a) forming a development blank plate material (50) formed with a base plate portion (20); a brimmed channel-shaped frame portion (30) extending outwardly from the base plate portion and including a side surface portion (31), two cutter plate portions (32*a*, 32*b*) extending from said side surface portion and formed with two open slots (34*a*, 34*b*) respectively, and two brim portions (33*a*, 33*b*) extending from said two cutter plate portions respectively; and a reinforcement portion (40) formed with two brim holder portions (41*a*, 41*b*) extending outwardly from said reinforcement portion; (b) bending the two brim portions (33*a*, 33*b*) at right angles in a first direction with respect to said two cutter plate portions, respectively; (c) bending the two cutter plate portions (32*a*, 32*b*) at right angles in a second direction opposite to the first direction with respect to the side plate portion (31) to form a brimmed channel-shaped frame portion (30); (d) bending the brimmed channel-shaped frame portion and the reinforcement portion (40) simultaneously at right angles with respect to the base plate portion, so that the two brim portions (33*a*, 33*b*) are brought into contact with the reinforcement portion (40); and (e) bending the two brim holder portions (41*a*, 41*b*) into contact with the two brim portions, respectively, to reinforce the brimmed channel-shaped frame portion.

In the wire insulator pressure-cut connector terminal according to the present invention, since the open slots for cutting the wire insulator are formed in a brimmed channel-shaped frame portion, and further the brimmed channel-shaped frame portion is reinforced by the reinforcement portion, it is possible to sufficiently increase the rigidity of the cutter plates. Further, the brimmed channel-shaped frame portion can be bent by two mated dies having no hollow cavity therebetween, it is possible to bent the pressure-cut terminal into an accurate shape and in precise dimensions for providing a higher reliability of the connector terminal.

BRIEF DESCRIPTION OF THE DRAWINGS

The features and advantages of the wire insulator pressure-cut connector terminal according to the present invention will be more clearly appreciated from the following description taken in conjunction with the accompanying drawings in which.

DETAILED DESCRIPTION OF THE PREFERRED EMBODIMENT

Figure 1A:
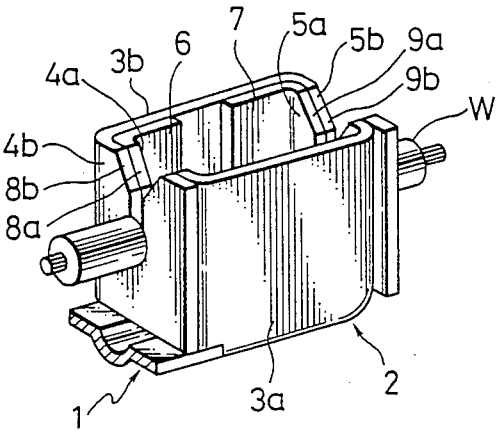
FIG.1(A) PRIOR ART
FIG. 1(A) is a perspective view showing an example of prior-art wire insulator pressure-cut connector terminal.
Figure 1C:
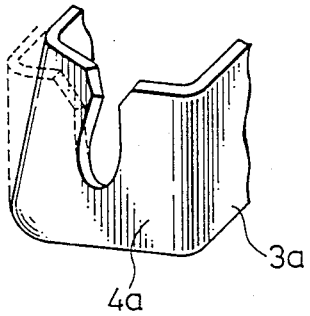
FIG.1(C) PRIOR ART
FIG. 1(C) is a partial perspective view of the same prior-art connector terminal shown in FIG. 1(A), for assistance in explaining defects or problems involved in the prior-art connector terminal shown in FIG. 1(A)
Figure 1B:
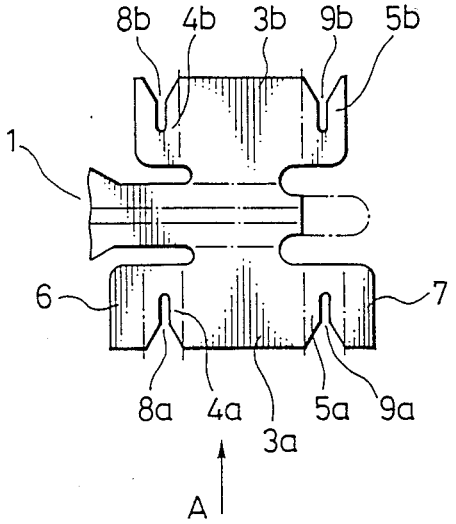
FIG.1(B) PRIOR ART
FIG. 1(B) is an development elevation showing the connector terminal shown in FIG. 1(B)
Figure 2A:
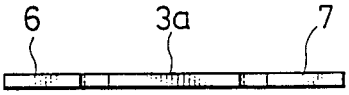
FIG. 2(A) PRIOR ART
FIG. 2(A) is a side view showing the flat blank plate material of the connector terminal when seen from the direction A in FIG. 1(B)
Figure 2B:
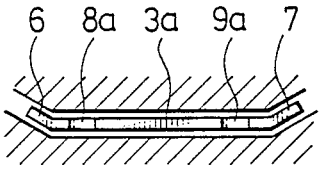
FIG. 2(B) PRIOR ART
FIGS. 2(B) to 2(E) are partial cross-sectional views showing some bending dies, for assistance in explaining the bending steps of the prior-art connector terminal.
Figure 2C:
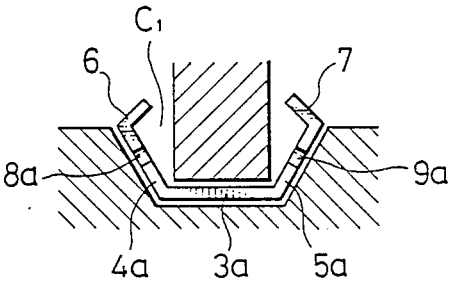
FIG. 2(C) PRIOR ART
Figure 2D:
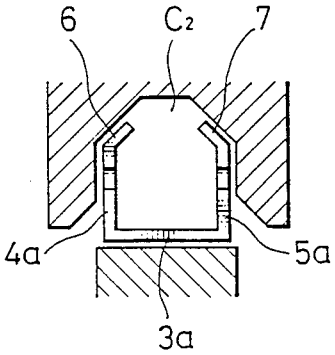
FIG. 2(D) PRIOR ART
Figure 2E:
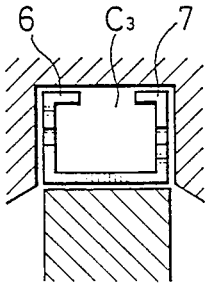
FIG. 2(E) PRIOR ART
Figure 3A:
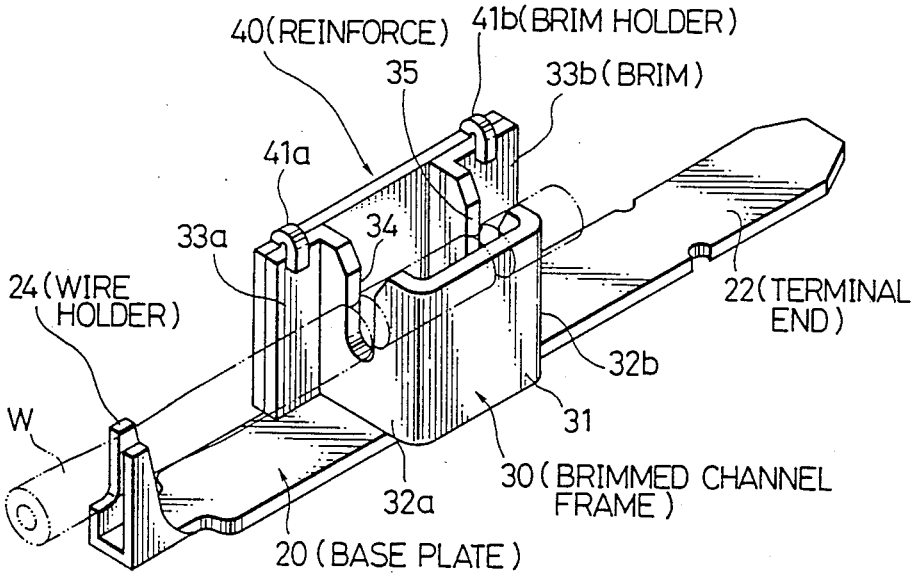
FIG. 3(A) is a perspective view showing an embodiment of the wire insulator pressure-cut connector terminal according to the present invention.
Figure 3B:
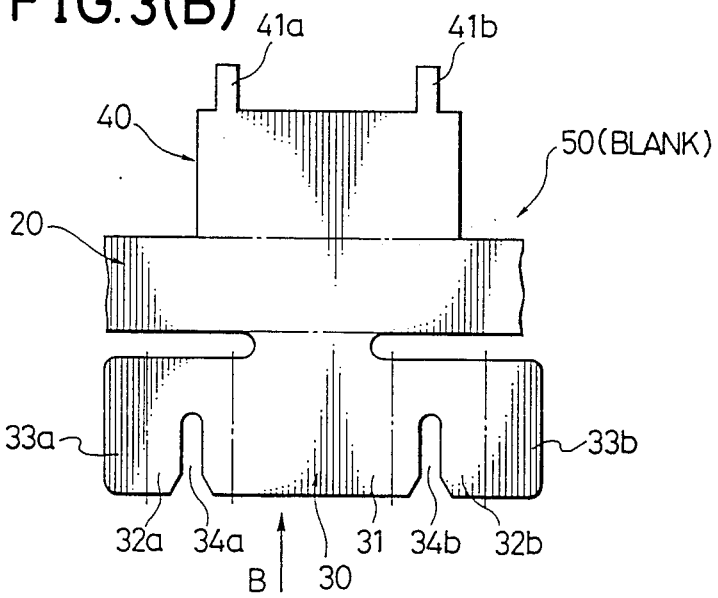
FIG. 3(B) is a development elevation showing the connector terminal shown in FIG. 3(A)

With reference to FIGS. 3(A) and 3(B), an embodiment of the wire insulator pressure-cut connector terminal (referred to as pressure-cut terminal) according to the present invention will be described hereinbelow.

The connector terminal is roughly formed with a base plate portion 20, a brimmed channel-shaped frame portion 30 and a reinforcement plate portion 40. The base plate portion 20 is formed with a male terminal end 22 mated with another female terminal (not shown) and a wire holder portion 24 for holding an insulated wire W. The brimmed channel-shaped from portion 30 is formed with a side surface 31 bent from the base plate portion 20, two opposing cutter plate portions 32*a* and 32*b* extending and bent from the side surface 31 and having two open slots 34*a* and 34*b*, respectively and two brim portions 33*a* and 33*b* extending and bent from the cutter plate portions 32*a* and 32*b*. The reinforcement portion 40 is formed with two brim holders 41*a* and 41*b* for holding the two brim portions 33*a* and 33*b* when bent as shown in FIG. 3A.

The above-mentioned pressure-cut terminal is formed by bending a blank plate 50 as shown in FIG. 3(B). That is, the side surface 31 is bent inward at a right angle from the base plate 20 along one longitudinal edge of the base plate 20; the two opposing cutter plate portions 32*a* and 32*b* are also bent inward at right angles from the side surface 31; and the two brim portions 33*a* and 33*b* are conversely bent outward at right angles from the cutter plate portions 32*a* and 32*b* so as to form a brimmed channel-shaped frame 30. On the other hand, the reinforcement portion 4 is bent inward at a right angle from the base plate 20 along the other longitudinal edge of the base plate 20 in parallel to the side surface 31 so as to close the opening space of the channel-shaped frame 30. Further, two brim holders 41*a* and 41*b* are also bent inward and downward to hold the two side brim portions 33*a* and 33*b* extending from the cutter plate portions 32*a* and 32*b*, respectively against the inner surface of the reinforcement plate portion 40 in order to increase the rigidity of the cutter plate portions 32*a* and 32*b* of the channel-shaped frame portion 30. Further, the wire holder 24 is also bent at right angles from the base plate 20, in order to hold the insulator wire.

FIG. 3(B) shows a development elevation of the pressure-cut terminal shown in FIG. 3(A). In bending process, the brimmed channel-shaped frame portion 30 is first formed; the formed frame portion 30 and the reinforcement plate portion 40 are bent inward simultaneously at right angles from the base plate 20; and the two brim holders 41*a* and 41*b* are bent so as to hold the two brim portions 33*a* and 33*b* into contact with the inner surface of the reinforcement plate portion 40.

Figure 4A:
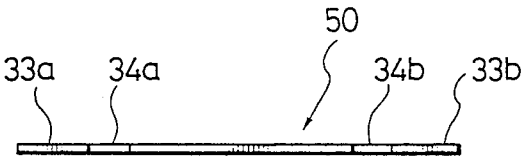
FIG. 4(A) is a side view showing the flate blank plate material of the connector terminal when seen from the direction B in FIG. 3(B)
Figure 4B:
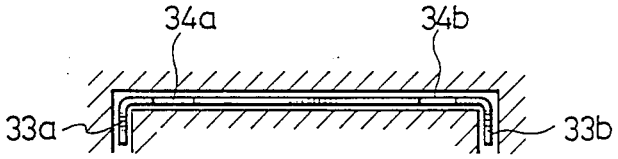
FIGS. 4(B) and 4(C) are partial cross-sectional views showing some bending dies, for assistance in explaining the bending steps of the connector terminal according to the present invention.
Figure 4C:
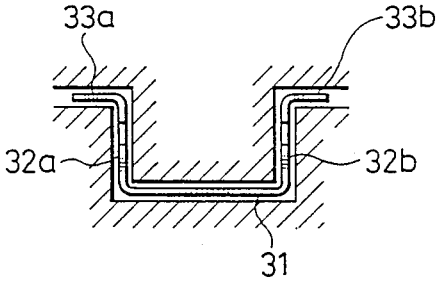

FIGS. 4(A) to 4(C) show bending steps of the brimmed channel-shaped frame portion 30. FIG. 4(A) shows a side view when the blank plate material 50 is seen from the direction B in FIG. 3(B). As shown in FIG. 4(B), two brim portions 33*a* and 33*b* are bent downward at right angles from the blank plate 50, and thereafter the two opposing cutter plate portions 32*a* and 32*b* are bent conversely upward at right angles from the side surface as shown in FIG. 4(C), so that the brimmed channel-shaped frame portion 30 can be formed by the above-mentioned bending process.

In the bending process as shown in FIGS. 4(B) and 4(C), since there exist no hollow cavity between the two mated upper and lower dies, it is possible to form or bent the brimmed channel-shaped frame portion 30 into an accurate shape and in precise dimensions, thus preventing the deformation of the cutter plate portions of the pressure-cut terminal even when a relatively large-diameter wire is pressure-fitted into the cutting open slots formed in the cutter plates.

As described above, in the wire insulator pressure-cut connector terminal according to the present invention, since the insulator cutting open slots are formed in the two opposing cutter plate portions of the brimmed channel-shaped frame reinforced by the reinforcement plate, it is possible to obtain a sufficient rigidity of the cutter plate portion. Further, since the brimmed channel-shaped frame can be formed by bending a blank plate material with two mated dies having no hollow cavity between the two dies, it is possible to form the pressure-cut terminal into an accurate shape and in precise dimensions, thus improving the reliability of the wire insulator pressure-cut connector terminal.

What is claimed is:

1. A wire insulator pressure-cut connector terminal, comprising:

(a) a base plate portion formed integral with a terminal end portion;

(b) a brimmed channel-shaped frame portion formed integral with said base plate portion and having a side surface portion bent at a right angle with respect to said base plate portion, two opposing cutter plate portions bent inwardly at right angles with respect to said side surface portion and formed with two open slots for cutting a wire insulator pressure-fitted thereinto respectively, and two brim portions bent outwardly at right angles with respect to said two opposing cutter plate portions respectively; and (c) a reinforcement portion formed integral with said base plate portion and bent at a right angle with respect to said base plate portion so as to be brought into contact with said two brim portions on both sides thereof, and formed with at least two brim holder portions for holding said two brim portions, respectively when bent inwardly against said brim portions.

2. The wire insulator pressure-cut connector terminal of claim 1, wherein said base plate portion is further formed with two wire holder portions bent at right angles with respect to said base plate portion.

3. A method of forming a wire insulator pressure-cut connector terminal, which comprises the following steps of:

(a) forming a development blank plate material formed with a base plate portion; a brimmed channel-shaped frame portion extending outwardly from the base plate portion and including a side surface portion, two cutter plate portions extending from said side surface portion and formed with two open slots respectively, and two brim portions extending from said two cutter plate portions respectively; and a reinforcement portion formed with two brim holder portions extending outwardly from said reinforcement portion;

(b) bending the two brim portions at right angles in a first direction with respect to said two cutter plate portions, respectively;

(c) bending the two cutter plate portions at right angles in a second direction opposite to the first direction with respect to the side plate portion to form a brimmed channel-shaped frame portion;

(d) bending the brimmed channel-shaped frame portion and the reinforcement portion simultaneously at right angles with respect to the base plate portion, so that the two brim portions are brought into contact with the reinforcement portion; and (e) bending the two brim holder portions into contact with the two brim portions, respectively, to reinforce the brimmed channel-shaped frame portion.

* * * * *